US006092805A

United States Patent [19]

Lee

[11] Patent Number: 6,092,805

[45] Date of Patent: Jul. 25, 2000

[54] STRUCTURE OF A SOCCER GAME TABLE

[75] Inventor: Ming-Kuo Lee, Taipei, Taiwan

[73] Assignee: Hi-Star Co., Ltd.

[21] Appl. No.: 09/250,149

[22] Filed: Feb. 16, 1999

[51] Int. Cl.[7] ..... A63F 7/36

[52] U.S. Cl. ..... 273/108.1; 273/108.52; 273/122 R

[58] Field of Search ..... 273/121 R, 121 D, 273/122 R, 122 A, 125 R, 126 R, 127 C, 108, 108.1–108.57, 309; 473/10, 14, 22

[56] References Cited

U.S. PATENT DOCUMENTS

| | | |
|---|---|---|
| 3,741,541 | 6/1973 | Crismani . |
| 3,870,303 | 3/1975 | Patterson . |
| 4,025,073 | 5/1977 | Furr . |
| 5,326,102 | 7/1994 | Chang . |

*Primary Examiner*—Sebastiano Passaniti
*Attorney, Agent, or Firm*—A & J

[57] ABSTRACT

A soccer game table is characterized in that each of the long side panels has two inner ends each having two recesses, one of the long side panels having an end formed with an opening, and each of the short side panels comprising a pair of caps having similar shape as an end of the long side panel, an outer side of each of the caps having two protuberances adapted to engage with the two recesses, an inner side of each of the caps being provided with an upper frame which is a U-shaped member having a distance from an inner top of each of the caps and an inner front side of each of the caps, a lower frame located under the upper frame and having a distance from an inner bottom of each of the caps, and a fin located horizontally opposite to a bottom of each of the caps, and a fin located horizontally opposite to a lower end of the upper frame, one of the short side panels having an opening aligned with the opening of one of the long side panels, an elongated block arranged within each of the short side panels and having two ends fitted between a bottom of the upper frame and a top of the lower frame, the elongated block having a top formed with a sloping groove having a lower end close to the opening of one of the caps.

3 Claims, 3 Drawing Sheets

STRUCTURE OF A SOCCER GAME TABLE

BACKGROUND OF THE INVENTION

1. Field of the Invention

This invention is related to an improvement in the structure of a soccer game table.

2. Description of the Prior Art

The conventional soccer game table generally includes a table top, a plurality of supporting legs and two ball collecting chambers. The collecting chambers are each arranged behind a goal, i.e. at two opposite sides of the soccer game table. However, such a soccer game table is difficult to manufacture and assemble thereby increasing the cost.

Therefore, it is an object of the present invention to provide an improvement in the structure of a soccer game table which can obviate and mitigate the above-mentioned drawbacks.

SUMMARY OF SAID INVENTION

This invention is related to an improvement in the structure of a soccer game table.

It is the primary object of the present invention to provide an improved soccer game table which is easy to assemble.

It is another object of the present invention to provide an improved soccer game table which is simple in construction.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
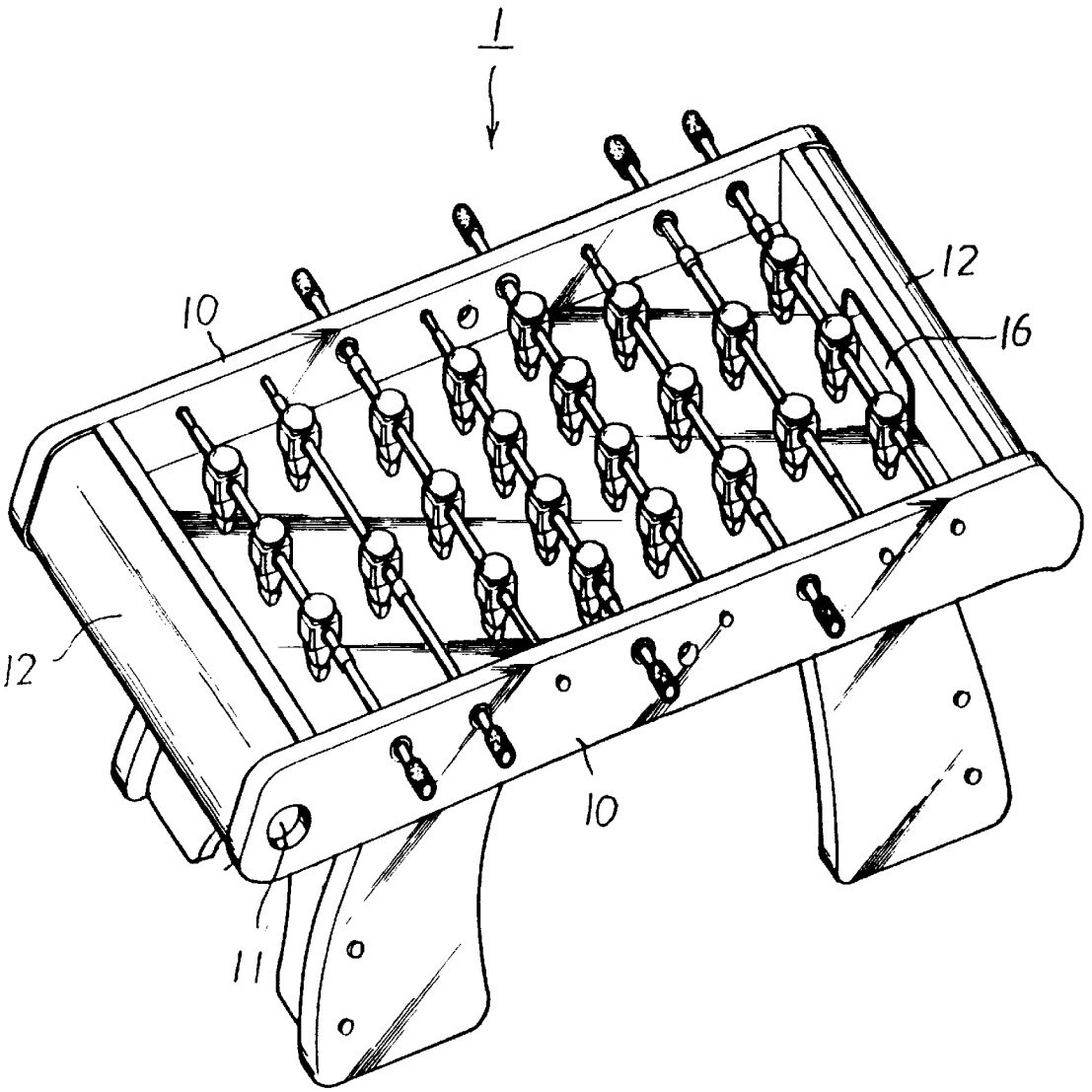
FIG. 1 is a perspective view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
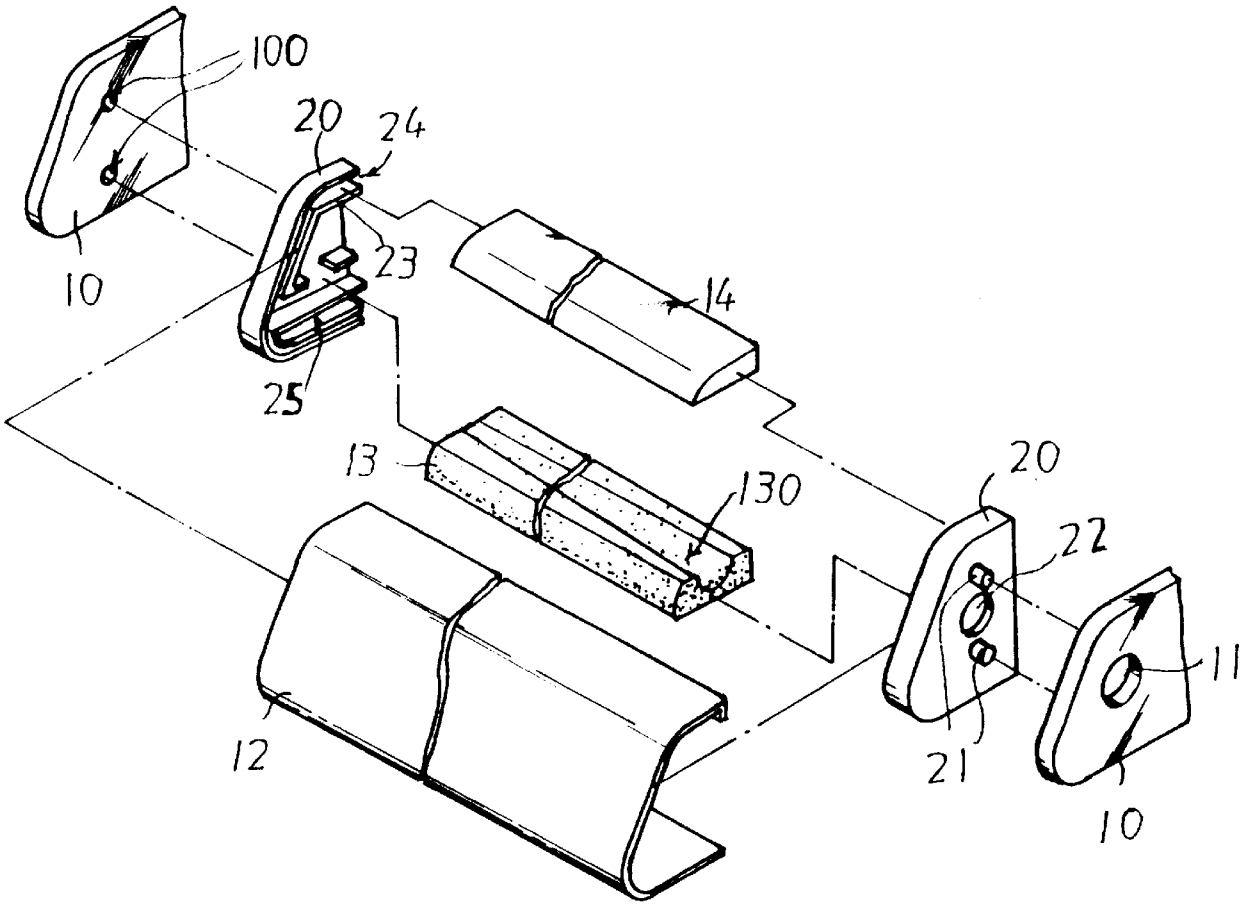
FIG. 2 is an exploded view of the present invention.

With reference to the drawings and in particular to FIGS. 1 and 2 thereof, the soccer game table 1 according to the present invention generally comprises two long side panels 10, two short side panels 12 mounted between the two long side panels 10 to form a rectangular casing, a bottom panel 15 mounted on the bottom of the rectangular casing, and a base (shown but not numbered) on which is mounted the bottom panel 15. The inner end of the long side panel 10 is provided with two recesses 100. One of the long side panels 10 is formed with an opening 11 at an end thereof.

Each of the short side panels 12 has a pair of caps 20 having the same shape as the end of the long side panel 10. The outer side of the cap 20 has two protuberances adapted to engage with the two recesses 100 at the inner end of the long side panel 10. The inner side of the cap 20 is provided with an upper frame 23 which is a U-shaped member having a distance from the inner top of the cap 20 and an inner front side of the cap 20, a lower frame 25 under the upper frame 23 and having a distance from the inner bottom of the cap 20, and a fin 231 located horizontally opposite to the lower end of the upper frame 23. One of the caps 20 is formed with an opening 22 which is aligned with the opening 11 of the long side panel 10.

Figure 3:
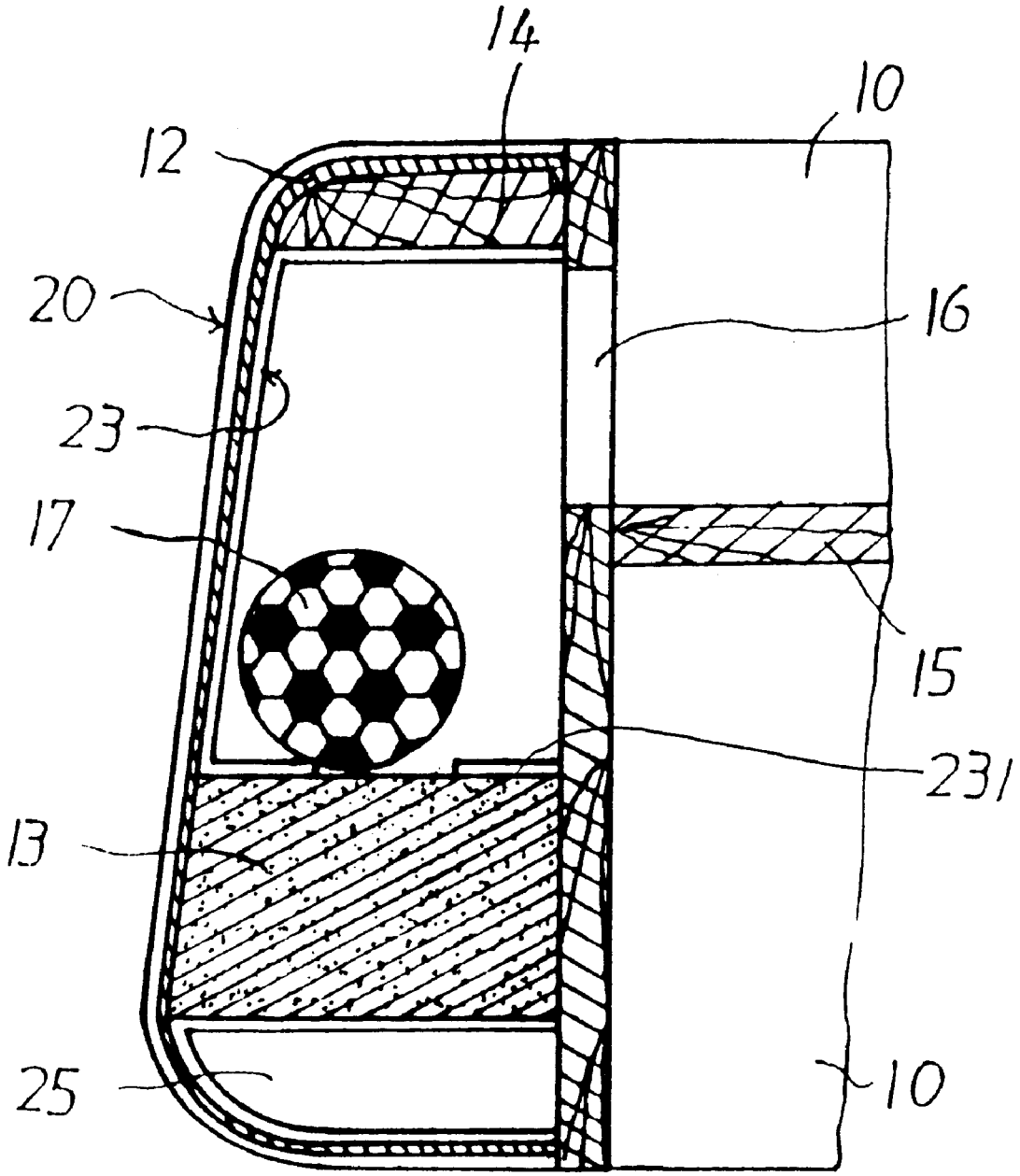
FIG. 3 is a sectional view of the present invention.

The short side panel 12 is an elongated member having a curved contour and two ends configured to engage with the two caps 20 (see FIG. 3). Referring to FIGS. 2 and 3, an elongated block 13 is arranged within the short side panel 12 between the two caps 20, with its two ends fitted between the bottom of the upper frame 23 and the top of the lower frame 25 for reinforcing the structure. The top of the elongated block 13 is formed with a sloping groove 130 having a lower end close to the opening 11 of the cap 10, so that once the ball 77 is kicked through a goal 16 along the bottom panel 15, the ball 17 will first fall down on the elongated block 13 and then automatically roll down the lower end of the sloping groove 130 thereby enabling the ball 17 to be taken out from the opening 11 easily. An elongated stuffing member 14 is arranged in the short side panel 12 between the two caps 20, with its two ends fitted between the inner top of the cap 10 and the top of the frame 23 so as to reinforcing the structure.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. In a soccer game table having a pair of long side panels, a pair of short side panels connected with said two long side panels to form a rectangular casing, a bottom panel mounted on a bottom of said rectangular casing, and a base on which is mounted said bottom panel, the improvement wherein each of said long side panels has two inner ends each having two recesses, one of said long side panels having an end formed with an opening, and each of said short side panels comprising a pair of caps having similar shape as an end of said long side panel, an outer side of each of said caps having two protuberances adapted to engage with said two recesses, an inner side of each of said caps being provided with an upper frame which is a U-shaped member having a distance from an inner top of each of said caps and an inner front side of each of said caps, a lower frame located under said upper frame and having a distance from an inner bottom of each of said caps, and a fin located horizontally opposite to a lower end of said upper frame, one of said short side panels having an opening aligned with said opening of one of said long side panels, an elongated block arranged within each of said short side panels and having two ends fitted between a bottom of said upper frame and a top of said lower frame, said elongated block having a top formed with a sloping groove having a lower end close to said opening of one of said caps.

2. The soccer game table as claimed in claim 1, wherein each of said short side panels has a curved contour.

3. The soccer game table as claimed in claim 1, wherein each of said short side panels further comprises an elongated stuffing member arranged in each of said short side panel and having two ends fitted between an inner top of each of said caps and a top of said upper frame.

* * * * *